United States Patent [19]

Kessler

[11] 4,410,055

[45] Oct. 18, 1983

[54] DRILLING TOOL

[75] Inventor: Jürgen Kessler, Stuttgart, Fed. Rep. of Germany

[73] Assignee: Hilti Aktiengesellschaft, Schaan, Liechtenstein

[21] Appl. No.: 242,916

[22] Filed: Mar. 12, 1981

[30] Foreign Application Priority Data

Mar. 19, 1980 [DE] Fed. Rep. of Germany ..... 3010440

[51] Int. Cl.[3] ..... E21B 7/28

[52] U.S. Cl. ..... 175/173; 175/285

[58] Field of Search ..... 175/173, 285

[56] References Cited

U.S. PATENT DOCUMENTS 1,908,227 5/1933 Dodds ..... 175/173

4,105,081 8/1978 Perraud ..... 175/173

FOREIGN PATENT DOCUMENTS 163997 9/1964 U.S.S.R. ..... 175/173

*Primary Examiner*—William F. Pate, III

*Attorney, Agent, or Firm*—Toren, McGeady and Stanger

[57] ABSTRACT

A drilling tool for drilling a cylindrical borehole of relatively great depth in a soft material and then forming a conical enlargement adjacent the bottom of the borehole includes an axially elongated tool shank with a first drill at one end for cutting the cylindrical borehole and a second drill adjacent the first drill for cutting the conical enlargement. The second drill is formed of bit holders pivotally connected to a flattened part of the tool shank. An adjustable stop is provided on the tool shank for determining the depth of the borehole. A connecting link guide located within the tool shank interengages the bit holders and the tool shank. When the desired depth is reached, due to relative axial displacement between the tool shank and the connecting link guide, the bit holders are pivoted outwardly so that the second drill can cut the conical enlargement.

19 Claims, 9 Drawing Figures

DRILLING TOOL

This invention relates to a drilling tool suitable for producing a drill hole which at relatively great depth is provided with a conical enlargement, in a soft material, such as in a coal seam.

A drilling tool is known from German Patent Disclosure No. 28 56 855, in which a sliding block is attached directly to the stop part and can be moved in the slideways of the bit holders at a point of the drilling tool which is positioned directly in the carrying off zone for the drilled-out material. With this drilling tool setting depths can, therefore, be reached which correspond approximately to the length of the articulated bit holders which consist of two lever arms. However, due to the fact that the bit holders in the swung out position must lie within the diameter of the basic drill hole, this length is naturally relatively small, although it suffices for normal use, in for example aerated concrete, as mentioned in the publication in question.

For such fastening arrangements, which use an anchor bolt or peg which is inserted in form-locking fashion into the conical enlargement of the drill hole, a new field of application has come to the fore, for example in coal seams, in which the form-locking anchor bolts or pegs must be inserted at very great depths of for example 1,20 to 1,80 m. When threaded rods are then connected to the pegs, then on the outside of the coal bed elements such as beams, plates, discs or the like can be fastened to the threaded rod, which serve as a self-supporting protection of a drift or tunnel.

The known drilling tool is, however, in addition to its too low setting depth, also not suitable for this field of application, seeing that the open transmission mechanism from the axially movable tool shank to the swinging-out bit holders of the second drill, would be clogged up very quickly by the drilled out material, in particular the resultant coal dust, and would, therefore, become inoperable.

According to the present invention there is provided a drilling tool suitable for producing a drill hole which at relatively great depth is provided with a conical enlargement, in a soft material, the tool having a first drill to produce a basic cylindrical drill hole and a second drill to produce a conical enlargement, which in the direction of feed is provided in an articulated manner behind the first drill, the bit holders of which are attached in an articulated manner to both sides of a flattened part can be swung out sideways by means of a connecting link guide, the link guide having a slide block which is attached rigidly to a stop part for determining the setting depth of the conical enlargement, and a slideway which is provided on the bit holders of the second drill, which on the other hand can move against the action of a spring, characterized in that the slide block is connected to one end of a tie rod, which is guided essentially over its entire length concentrically inside a long hollow cylindrical tool shank in an axially movable manner, and which at its other end is attached rigidly to the stop part, in that the tool shank at its end provided with the first drill is formed with a flattened part to hold the second drill, and in that the slideway on the bit holders of the second drill is formed by grooves machined into the inside surfaces which face one another.

With the drilling tool according to the invention, a transmission mechanism is, therefore, created between the axially movable tool shank and the swinging-out bit holders of the second drill, which is arranged practically completely inside the tool shank, and is therefore covered and protected, so that it cannot be clogged up by coal dust or powder. This applies not only to the provided tie rod, but also to the connecting link guide consisting of slideways and slide blocks. Furthermore, this also applies not only to the articulated connection of the tie rod to the bit holders, but also to the end of the tie rod connected to the stop part, which, like the rest of the tie rod, is, at least over a substantial part of the tool shank length, covered off completely, on the outside.

According to an exemplified embodiment of the present invention, the first drill is a core drill which is provided on the flattened part of the tool shank in a detachable manner. As a result thereof, this core drill covers in an axial direction, seen from the front, the bit holders positioned behind it, and protects them against the drilled-out material, which according to a further exemplified embodiment of the present invention, is carried off by external spirals provided on the tool shank over the long distance of the drill hole depth. The drilling tool has, therefore, except in the area of the bit holders of the second drill, a round cross-sectional shape corresponding to that of normal drills, which permits a good carrying off of the drilled-out material, and an adequate guiding over the length of the drill hole to be produced.

With a further preferred exemplified embodiment of the present invention, the tool shank consists of a drill holder and a drill shank which carries the two drills, the drill holder and drill shank being connected to one another by means of a quick-change union. In this manner, when the two drills are worn, a new drill shank can very quickly be attached to the drill holder. The possibility of, for example, a bayonet union required turning of the drill shank with, in particular, the second drill and, therefore, in relation to the transmission mechanism, i.e. the tie rod with the slide block, is provided in a constructionally simple manner in that the tie rod is attached to a tension piston, which in relation to the tie rod is rigid in an axial direction but movable in the peripheral direction, and in that the slideways which are covered on the outside, are open at the end corresponding to the swung-out position of the bit holders, so that the slide block can easily be pulled out of same.

According to a further exemplified embodiment of the present invention the setting depth can be varied, in that the stop part can be adjusted, preferably in an infinitely variable manner, and attached to the tie rod. Furthermore, it is possible to adjust the depth of the conical enlargement in that the part limiting the axial relative movement between tool shank and tie rod, can also be adjusted, preferably step-wise, along the tool shank and be fixed into position. If one does not want to provide these many adjustment possibilities, it is also possible to insert an extension piece between the drill holder and drill shank, and to design the tie rod in such a manner that it can either also be lengthened or exchanged.

The stop part can for example be designed as a large-surface, disc-shaped cutter head, so as to provide the outside wall of the coal seam provided with the drill hole, at the end of the drilling operation, with a large surface plane for the plane-accurate putting on of fastening elements. If this is not necessary, the stop part can also be provided in the known manner as a basket. In that case it is, however, expedient to provide the stop ring in such a manner that it can move in an axial direction in relation to the rest of the basket, against the action of a spring, so that during the rough underground work the basket is not damaged by too severe an impact when the setting depth is reached.

Further details and embodiments of the invention can be noted from the following description, in which the invention is described and explained in greater detail with reference to the exemplified embodiments illustrated in the drawings, in which.

Figure 6:
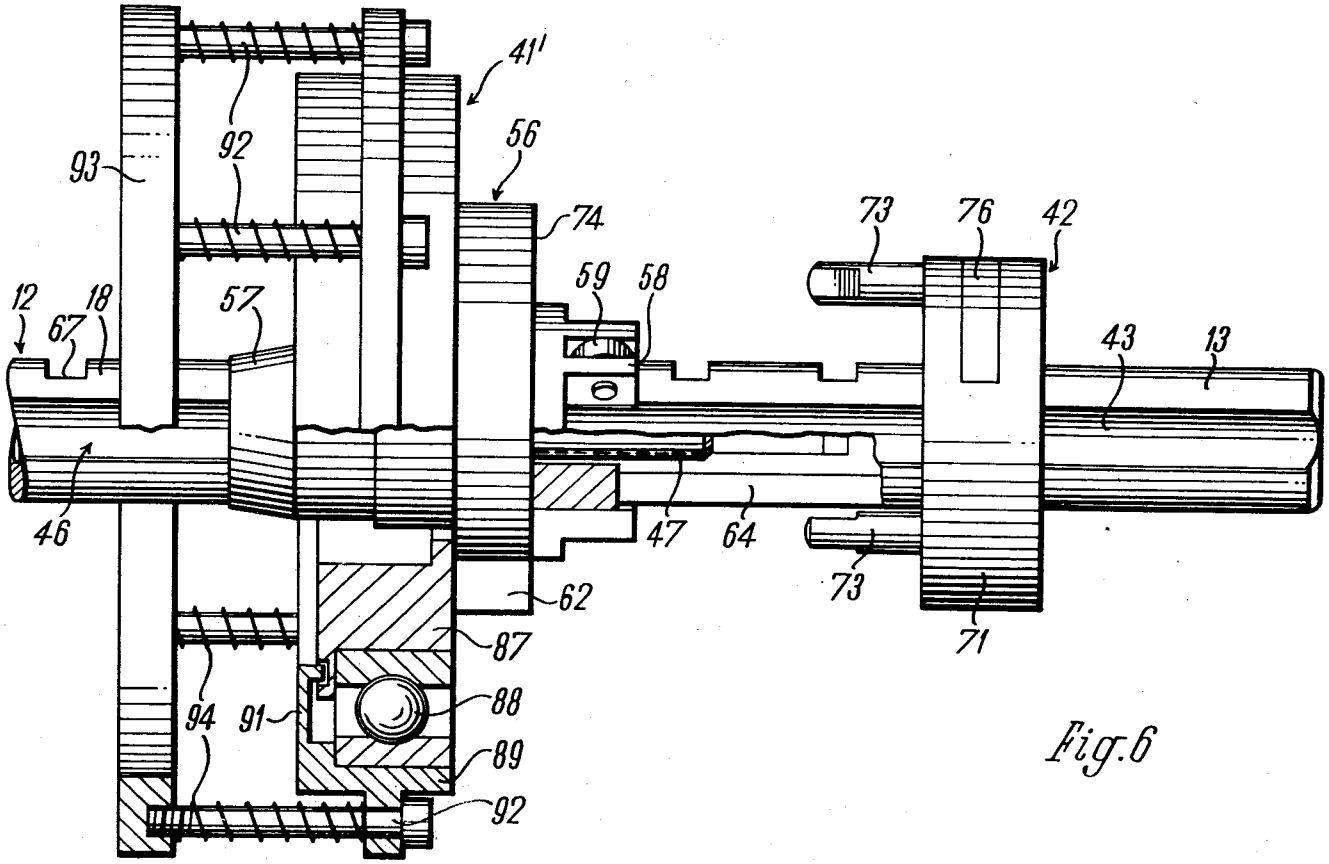
Figure 7:
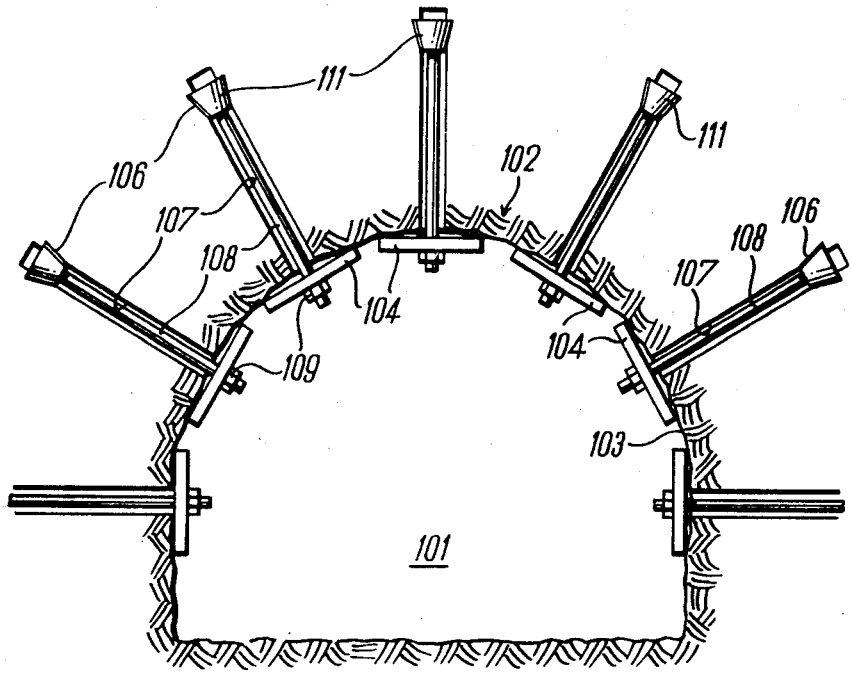

FIG. 6 shows a partially cut-away side view of the rear part with clamping-in end of a drilling tool according to another exemplified embodiment of the present invention; and FIG. 7 is a diagrammatic representation of a section through the tunnel of a coal seam to illustrate the field of application of the present invention and to illustrate an anchor bolt inserted into the drill hole produced with the aforementioned drilling tool according to the present invention.

The drilling tool 11 according to the invention serves to produce cylindrical basic drill holes 107 of great depth and to produce a conical enlargement 106 at the base of the cylindrical basic drill hole 107 at a great setting depth of for example about 1,20 to 1,80 m, or greater, in soft material, for example in coal seams, as will still be illustrated with reference to FIG. 7.

Figure 1A:
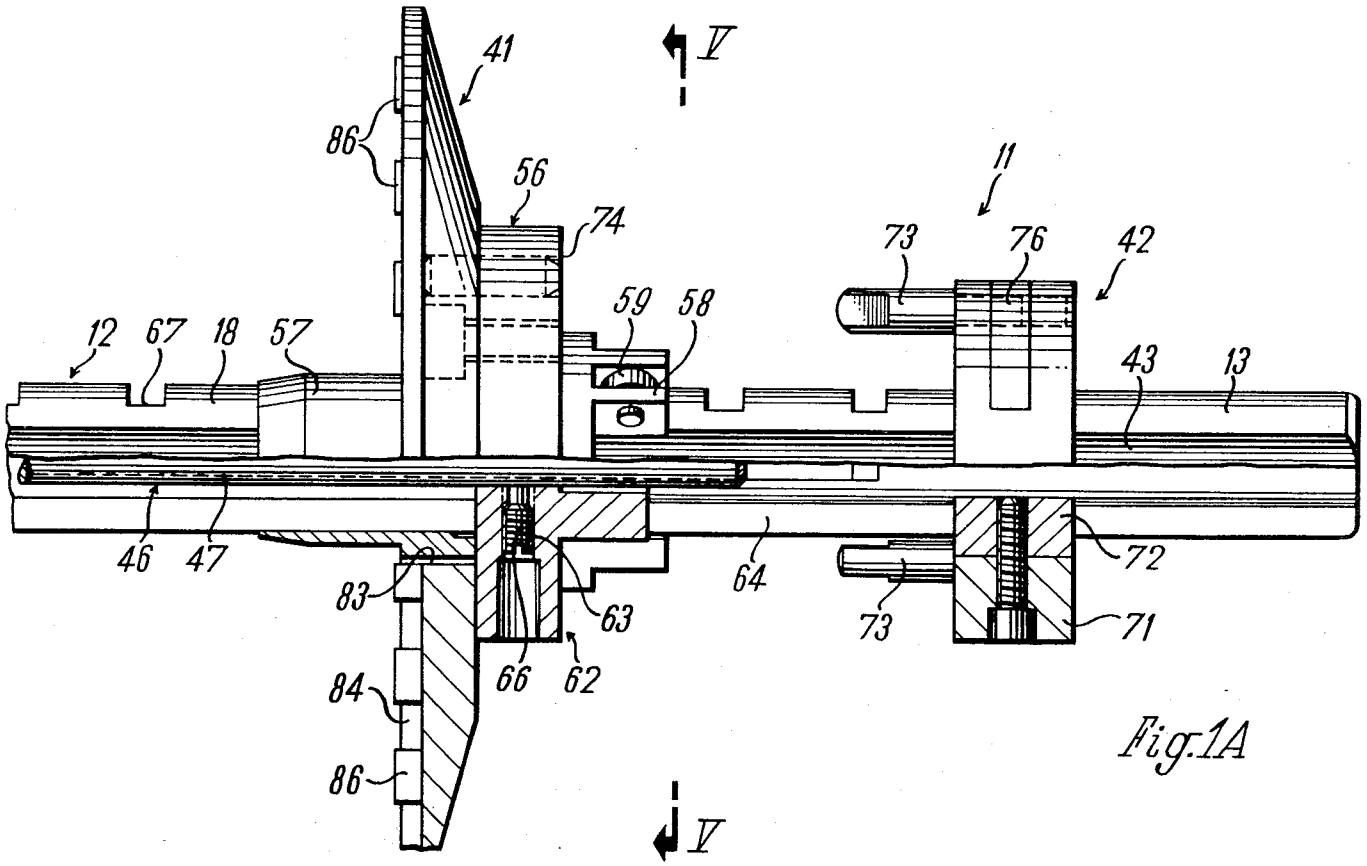
FIG. 1 shows a partially cut-away side view of a drilling tool according to an exemplified embodiment of the present invention, made up of part-FIG. 1A showing the rear part of the drilling tool with the clamping-in end, part-FIG. 1B the partially broken off centre part, and part-FIG. 1C the front part of the drilling tool provided with the drills.
Figure 1B:
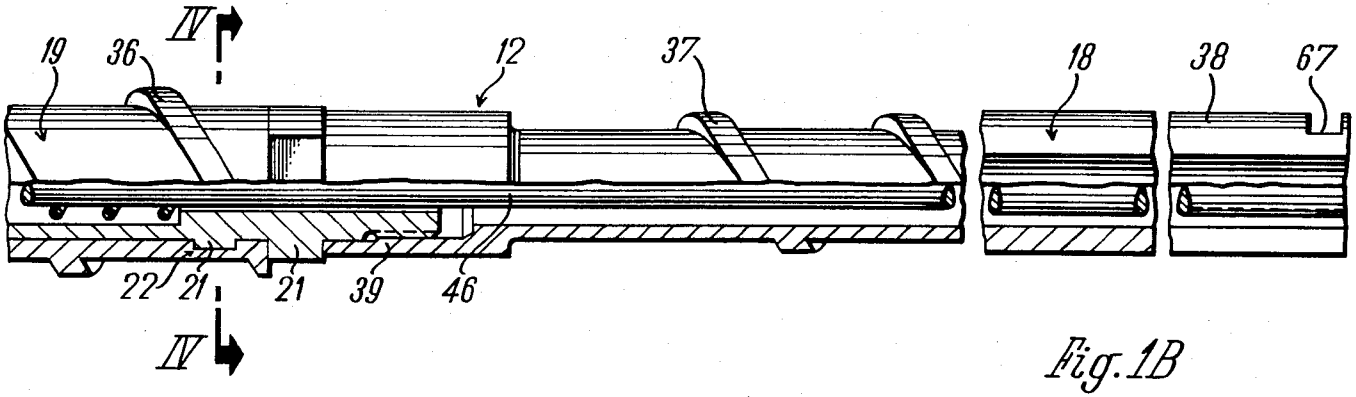
Figure 3:
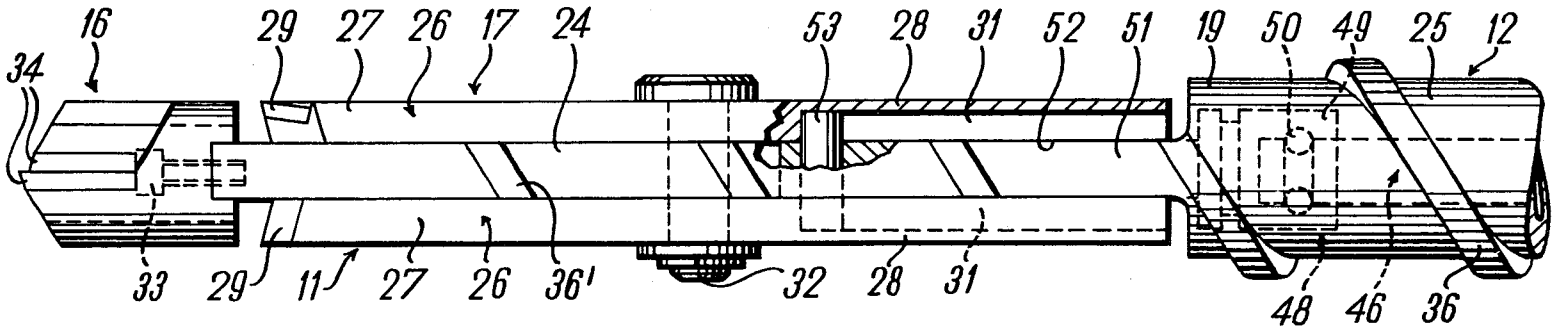
FIG. 3 shows a side view in relation to the side view of FIG. 1 turned through 90°, of the front and partially of the centre part of the drilling tool of FIG. 1C.
Figure 4:
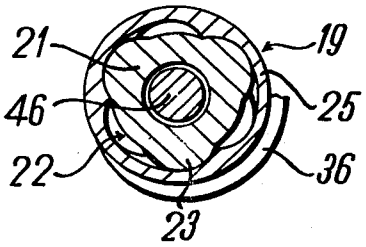
FIG. 4 shows a section along the line IV—IV of FIG. 1B.

The drilling tool 11 has a tool shank 12, which at its clamping-in end 13 is driven in a rotating manner by a non-illustrated drilling machine, hammer drill or the like, and which at its front end has a first drill 16 to produce the basic drill hole 107 and positioned behind same, in the direction of feed, a second drill 17 for the enlargement 106. With this exemplified embodiment the tool shank 12 is split into two, i.e. it consists of a hollow cylindrical drill holder 18 and a drill shank 19, which with the interposition of a coupling sleeve 21 are connected to one another in a detachable manner by a quick-change union 22 in the form of a bayonet union. This means that the drill shank 19, which carries the drills 16 and 17, is connected to the drill holder 18 in a quickly exchangeable manner. As can be noted from part-FIG. 1B and FIG. 4, the bayonet union 22 is shaped in such a manner that the coupling sleeve 21 has a three half-moon-shaped formed-on parts 23 in each instance offset by 60°, which can engage behind three corresponding radial formed-on parts in corresponding recesses at the end of the drill shank 19. When the drill shank 19 is turned through 30° in relation to the coupling sleeve 21, in the one or the other direction, the formed-on parts of the two elements 19, 21 move next to one another, due to which they can be pulled apart in the axial direction. The drill shank 19 has in addition to the hollow cylindrical part 25 extending into the zone of the coupling sleeve 21, a part 24 which is flattened on two diametrically opposite sides, which, as illustrated by FIG. 3, as a result thereof becomes a relatively narrow plate, against the opposite broad sides of which the respective bit holder 26 rests. The bit holders 26 can swing out parallel to these lateral faces.

The bit holders 26 are identical, but are arranged not only on opposite sides of the flattened part 24, but also in such a manner that they face away from one another. Every bit holder 26 consists of two single-piece arms 27, 28 connected to one another at an overobtuse angle, of which the arm 27 carries a bit 29 and of which the arm 28 is provided with a slideway 31 in the form of a groove. The groove 31 runs practically over the entire length of the arm 28, is machined in from the inside facing the flattened part 24 and has one end, i.e. it is open on the side of the free end of the arm 28. In the connecting zone of the two arms 27, 28, an opening is provided in each of the bit holders, which opening is in line with an opening in the flattened part 24. Through these openings a swivel axis 32 is inserted, by which furthermore the two bit holders 26 are kept lying closely against the flattened part 24. To the front end or the face of the flattened part 24, the first drill in the form of a core drill 16 is attached by means of a screw 33. The core drill 16 is, as a whole, U-shaped in cross-section, the horizontal legs of the U each being provided with a cutting blade according to FIG. 1, the cutting edges of which cutting blades 34 lie in one line diametrically opposite one another, but which in the direction of the feed are of a different height (see also FIG. 3). The outside diameter of the cutting blades 34 is slightly greater than the outside diameter of the U-shaped core drill 16, the outside diameter of which is equal to the outside diameter of the conveying spirals 36, which extend over the outside periphery of the drill shank 19 with a specific pitch in order to carry off the so-called drillings during the making of the drill hole 106, 107. Whereas the spirals in the zone of the hollow cylindrical part 25 of the drill shank run over the entire outer periphery, as can be noted from FIGS. 1 and 3, in the zone of the flattened part 24 only rudiments thereof have been left in the form of short pieces of spiral 36'.

The coupling sleeve 21 which by means of the bayonet union 22 is connected to the drill shank 19, is provided with an external thread and, by means of a fork spanner connection, firmly screwed into an end enlargement 39 of the drill holder 18. The drill holder 18 is provided with a conveying or discharge spiral 37 over its front zone, the outer diameter of which corresponds to that of the enlargement 39. This zone of the drill holder 18 provided with the discharge spiral 37 is followed by a holding zone 38, on which a stop part 41 or 41' is guided movable in the axial direction and to which a limiting part 42 is attached in an adjustable manner, and which goes over into the clamping-in end 13. The outside diameter of this holding zone 38 corresponds to that of the discharge spiral 37 and has on the outer periphery two diametrically opposed concave grooves 43 arranged lengthwise (see FIG. 1A), which serve to pass on the drilled-out material conveyed from the inside of the drill hole by means of the spirals 36 and 37.

Inside the tool shank 12 or the drill holder 18, and the drill shank 19, a tie rod 46 is held and guided movable in the axial direction in relation to these elements. The tie rod 46 is provided with an external thread 47 at its one end and is connected in an axially unmovable and non-turning manner to the stop part 41 or 41', and ends on the other end inside the drill shank 19 in front of the flattened part 24. The outside diameter of the tie rod 46 is substantially the same over the entire length, i.e. it is guided axially inside the drill holder 18 and inside the coupling sleeve 21 without appreciable play in the radial direction. The inner end of the tie rod 46, which has a greater distance from the inside wall of the hollow cylindrical part 25 of the drill shank 19, is stuck into the cylindrical end 49 of a tension piston 48, and is connected to same by means of a ring 50, rigid in the axial direction, but movable in relation to same in the peripheral direction. This cylindrical part 49 of the tension piston 48 is followed in one piece, as can be noted in particular from FIG. 3, by a plate-shaped flattened part 51, which is pushed into a longitudinal slot 52 in the flattened part 24 of the drill shank 19, and which at its free end has a cross-pin 53 which projects beyond both its flattened parallel sides, which constitutes the slide block which at both ends fits into the slideways 31 of the bit holders 26, as can be noted from FIG. 3. The slot 52 is for a substantial part covered on both sides by the arms 28 of the bit holders 26, the covered zone being greater during the producing of the conical drill hole enlargement than in the neutral position illustrated in FIG. 1, in which the slide block 53 lies in the slideways 31 near the inner ends, the slideways 31 running at a sharp angle in the opposite direction to the slot 52 which determines the path of movement or direction of the cross-pin 53.

The tie rod 46 is at its inner end surrounded by a compression spring 54, which at the one end rests on the cylindrical part 49 of the tension piston 48 positioned tightly movable by means of an O-ring inside the drill shank 19, and at the other end on an inside shoulder of the coupling sleeve 21, which with a zone of thinner wall thickness and greater inside diameter than the part provided with the bayonet union, surrounds the compression spring 54 in a guiding manner over a certain length.

The replacing of a drill shank 19 with the two, for example, worn drills 16 and 17 takes place as follows: the drill shank 19 is turned in relation to the coupling sleeve 21 or the drill holder 18, and can then be pulled off the coupling sleeve 21 in the axial direction. Seeing that during this turning, the drill shank 19 is also turned in relation to the tie rod, the tension piston 48 provided with the slide block 53 is connected to the tie rod 46 in a rotating manner, so that with the turning of the drill shank 19 and, therefore, of the second drill 17, also a turning of the slide block 53 in relation to the tie rod is rendered possible. During the axial pulling-out movement of the drill shank 19, the slide block 53 slides in the slideways 31 of the bit holders 26 and can get out at the free ends of the bit holder arms 28. A new drill shank 19 with new drills 16, 17 can be put in in a corresponding manner, after the two bit holders 26 have first been brought into the swung-out position, in which the slideways 31 are opposite the slot 52 and, therefore, opposite the slide block ends.

Figure 1C:
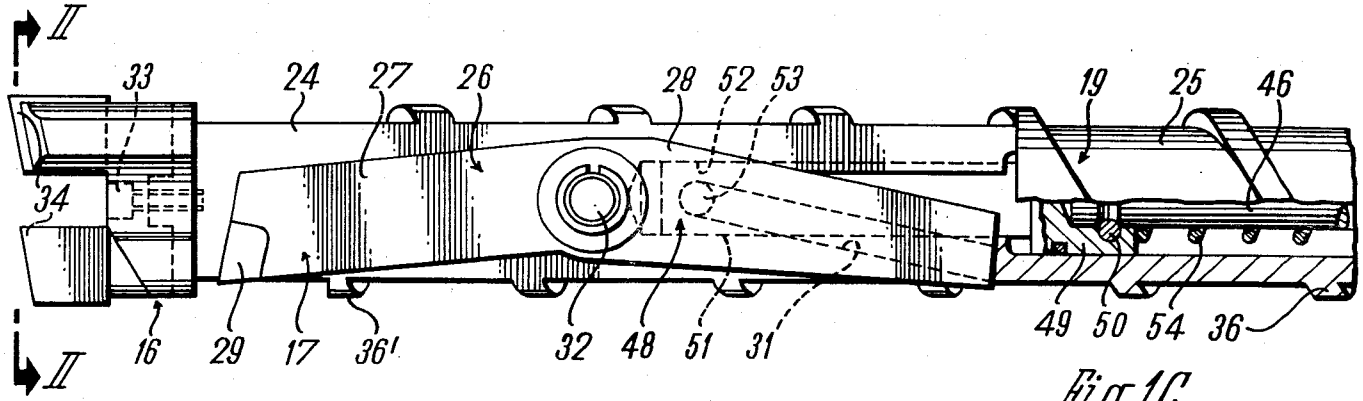
Figure 5:
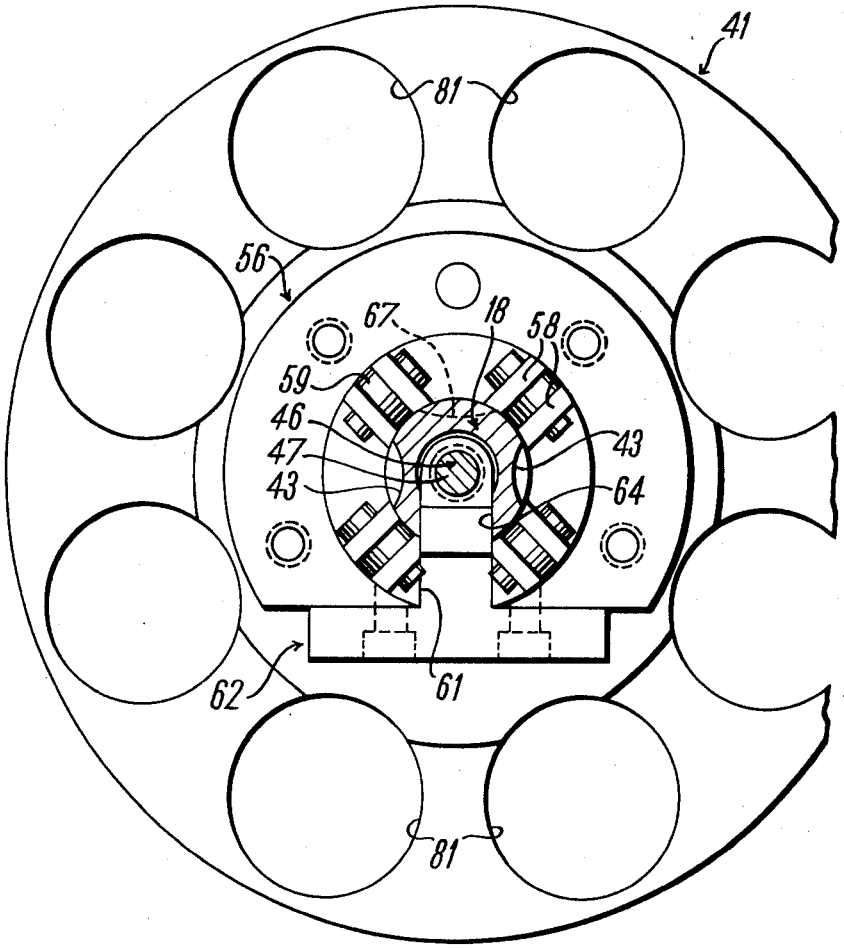
FIG. 5 shows a section along the line V—V of FIG. 1A.

The stop part 41, which according to FIG. 1 is designed as a cutter head, or the stop part 41', which according to FIG. 6 is designed as a basket, can optionally be fastened to the threaded end 47 of the tie rod 46 by means of a flange 56. The flange 56 has a guide sleeve 57, which at its front end tightly engages the drill holder 18, although axially movable, and which at its rear end, as can be noted in particular from FIG. 5, is provided with four pairs of eyes 58 positioned at a uniform angular distance from one another, to which rollers 59 are attached, which can roll on the outer periphery of the drill holder 18, when the drill holder 18 is moved axially in relation to the tie rod 46 and, therefore, to the flange 56.

The flange 56 is provided with a radial groove 61 between two pairs of eyes 58, into which groove 61 an in the rear-view approximately T-shaped cam 62 is inserted, which is fixedly connected to the flattened peripheral zone of the flange 56 by means of screws indicated by dots. The cam 62 has on its free end of the middle web of the upside down T a threaded bore 63, by means of which it can be screwed onto the threaded end 47 of the tie rod 46. Seeing that the cam 62 furthermore penetrates through a longitudinal slot 64 in the drill holder 18, it can depending on the axial screwing-on length on the tie rod 46, be adjusted in an infinitely variable manner in relation to same. In other words, depending on the screwing-on length of the cam 62 and therefore of the flange 56 and therefore of the stop part 41 or 41', the setting depth of the drilling tool 11, i.e. the distance from the stop part 41, 41' to the first and second drill 16, 17 respectively, can be adjusted in an infinitely variable manner. The fixing into position of a specific adjusted setting depth is achieved by means of a clamping screw 66, which can be screwed into the cam 62 in a radial direction and can be pressed against the threaded end 47 of the tie rod 46. The penetrating of the cam 62 through the longitudinal slot 64 in the drill holder 18, which slot is in line with the groove 61, results in a non-turning connection between same or the tie rod 46 and the drill holder 18. As can be noted from FIG. 5, the longitudinal slot 64 is arranged in such a manner that the roller 59 of the flange 56 roll along outer periphery zones of the drill holder 18, which extend between the longitudinal slot 64 and the concave grooves 43 or between same and cross-grooves 67 positioned in line at a certain distance behind one another and diametrically opposite the longitudinal slot.

These cross-grooves 67 serve to adjust the limiting part 42 along the drill holder 18. The limiting part 42 has a disc 71 provided with an axial groove, which groove lies opposite the longitudinal slot 64 of the drill holder 18. By means of a groove block 72 engaging in the groove and in this longitudinal slot, the disc 71 is connected to the drill holder 18 in a turn-locking manner. Bolts 73 projecting axially from the disc 71 towards the stop part 41, 41', are arranged distributed over the periphery of the disc 71, the free ends of which bolts 73 are positioned at a distance from a stop surface 74 of the flange 56, which distance corresponds to the depth of the conical undercut or enlargement 106. The axially rigid connection between the disc 71 and the drill holder 18 is obtained by means of a semi-disc-shaped adaptor part 76, which is put into a radial groove of the disc 71 and is screwed into position by means of a bolt 73. The inside surface of the adaptor part 76 is convex shaped corresponding to the concave grooves 43. In this manner the limiting part 42, which in the direction of feed is arranged behind the stop part 41, 41', can be adjusted in an infinitely variable manner in accordance with the adjusted setting depth and in accordance with the desired depth of the drill hole enlargement. The adapting of the drilling tool to different setting depths can also be achieved in that the tool shank 12 is made longer by intermediate parts, in which case the tie rod must be replaced or must also be made longer by an intermediate part.

Figure 2:
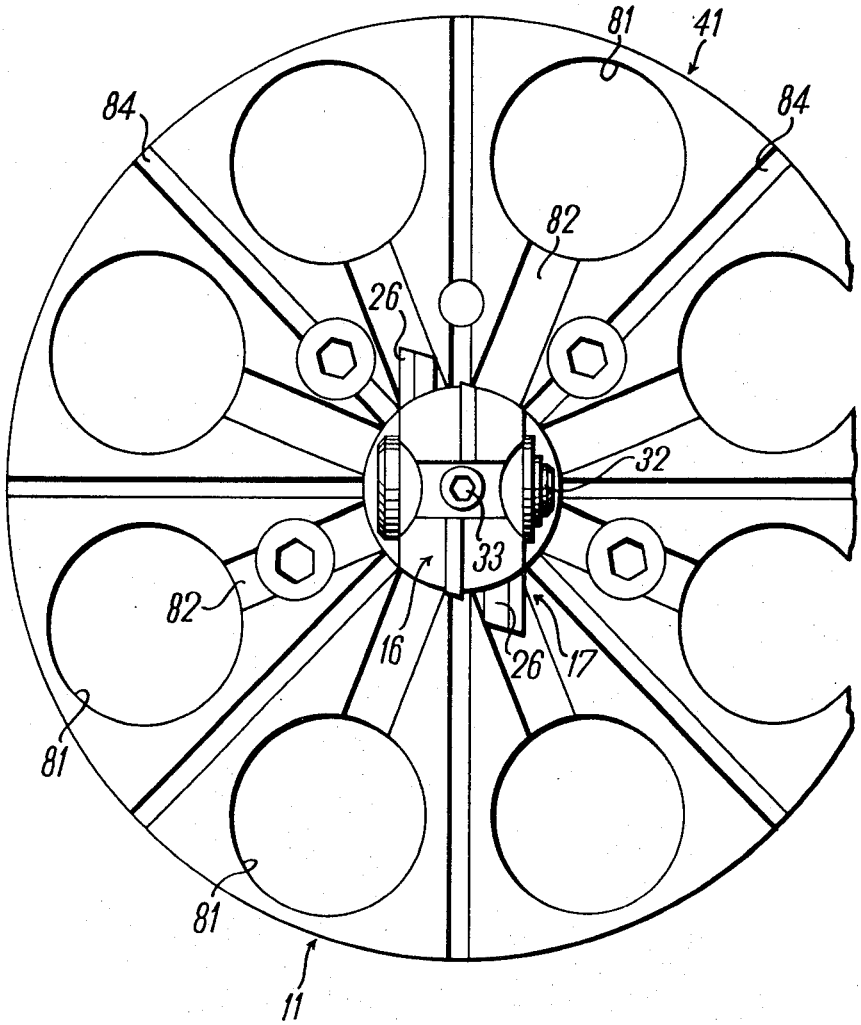
FIG. 2 shows a front view of the drilling tool according to line II—II of FIG. 1C, but according to a variation and with swung-out second drill.

As already mentioned, the stop part 41 according to FIG. 1, is a large diameter, flat, disc-shaped cutter head, which at the rear can be connected in a non-turning manner to the flange 56 by means of screws and fitting pins which are illustrated by broken lines. The rear and front view of the cutter head 41 are shown in FIGS. 5 and 2. With the exemplified embodiment the cutter head 41 has eight openings 81 distributed over the periphery, which in the form of bores are arranged near the outer periphery edge. From the openings 81 grooves 82 extend inwards in a radial direction towards the central bore 83 surrounding the guide sleeve 57 of the flange 56. These grooves 82 pass on the drilled out material coming via the outer periphery of the drill holder 18 and the guide sleeve 57 provided with a conical end, to the openings 81 and through these to the outside. Between the discharge grooves 82 arranged on the front surface (see FIG. 2), which become deeper towards the openings, further radial grooves 84 are provided, which extend over the entire radius of the cutter head 41 and which are narrower than the grooves 82. With the variation of FIG. 1, these grooves 84 serve to hold the blades 86 which project beyond the front surface, and which are arranged in the grooves 84 in rows behind one another, resulting for example in four rings of cutting blades provided at a distance from one another. According to the variation of FIG. 2, no cutting blades are provided in the grooves 84, but here the grooves 84 also serve to carry off the drilled out material. With this variation, the in the direction of rotation rear edges of the openings 81 on the front surface of the cutter head 41 are designed in a non-illustrated manner as cutting edges, in that they are for example only sharpened or slightly bent up. The cutter head 41 is provided so that, after the producing of the deep drill hole 107 with the conical enlargement 106, a flat surface can be milled out or cut out on the inside wall 103 of the tunnel 101 around the drill hole 107, so as to be able to put on in a flat manner boarding or support elements or the like, which must be fastened there.

As can be noted from the illustration of FIG. 6, the stop part 41' is designed as a basket. A bottom plate 87 of the basket 41', which surrounds the guide sleeve 57, is like the cutter head 41 screwed onto the flange 56, so that the bottom plate 87 is connected to the drill holder 18 in a nonturning manner. The bottom plate 87 is surrounded by a support ring 89, a radial ball bearing 88 being provided inbetween, which support ring 89 by means of a web 91 bridging the ball bearing 88 supports the bottom plate 87 in the direction of feed, whereby however, as before, the turning of the bottom plate 87 in relation to the support ring 89 is guaranteed. The supporting ring 89 is divided by means of a number of staybolts 92 over the periphery connected to a stop ring 93, which in the direction of feed lies in front of same, in such a manner that it can move in relation to same in the axial direction. To this effect the staybolts 92 are with their threaded ends screwed into the stop ring 93, and with their other ends penetrate openings in the support ring 89 in an axially movable manner, the heads of the staybolts resting against the outside of the support ring 89. The axial prestress between the support ring 89 and the stop ring 93 is obtained by the compression springs 94 surrounding the staybolts 92.

Production of a deep cylindrical basic drill hole 107 and the subsequent production of a conical enlargement 106 at the bottom of this basic drill hole at a specific setting depth, is achieved as follows: After applying the core drill 16 to the desired spot on the coal seam, by driving the tool shank 12, the cylindrical basic drill hole 107 is made, guiding the drill shank in the direction of feed. After reaching the preset setting depth, the stop part 41 or 41' comes into contact with the inside wall 103 of the tunnel 101, so that the stop part 41, 41' cannot be moved any further in the axial direction. When further axial feed now takes place in the direction of the arrow by pressing on the drilling machine or the like, only the tool shank 12 still moves forward, whereas the tie rod 46 connected to the stop part 41 or 41' remains stationary in an axial direction. This results in axial relative movement between the tool shank 12 and tie rod 46, and therefore also in relative movement in the connecting link guide, i.e. between the slideways 31 in the bit holder 26 of the second drill 17 and the slide block 53 at the end of the tie rod 46 or the tension piston 48. Consequently, the bit holders 26 are swung out by the connecting link guide 31, 53 during the further feed movement, and this in such a manner that the arms 27, fitted with the bits 29, are moved constantly radially outwards, resulting in a conical enlargement 106 going out from the basic drill hole, the end and maximum diameter of which conical enlargement 106 are reached, when the stop bolts 73 of the limiting part 42 hit against the rear surface of the flange 56, so that a further relative movement between tie rod 46 and tool shank 12 is no longer possible. In this position the slide block 53 has reached the open end of the slideways 31 in the arms 28 of the bit holder 26.

In the case of further intentional or unintentional axial feed, when using the cutter head 41, a flat surface is milled into the wall, or, when using the basket 41', this further axial movement is absorbed by the basket 41' against the action of the springs 94, so that it is ensured that it does not break.

FIG. 7 illustrates in a diagrammatic representation the preferred field of application or the preferred range of application. In underground coal mines tunnels 101 are driven in coal seams 102, the inside walls 103 of which must be secured. This takes place by producing, by means of the drilling tool 11 described in the foregoing, deep drill holes 107 which at the base are provided with a conical enlargement 106, into which drill holes a fastening element, e.g. a threaded rod 108 is inserted. To the end of the threaded rod 108 which first enters the drill hole a peg or anchor 111 is screwed on in a non-expanded condition, the anchor being expanded by a turning or tightening of the threaded rod 108, so that it fits in a form-locking fashion in the conical drill hole enlargement 106. The end of the threaded rod 108 sticking out of the drill hole 107 in the coal seam 102, is braced against the inside wall 103 by, for example, a short beam or a steel plate 104 by means of a nut 109 or a similar fastening element. In this manner a self-supporting support and securing of the inside wall 103 of the coal seam tunnel 101 in question is obtained. As mentioned in connection with the length of the drilling tool 11, these fastening drill holes 107 are about 1,20 to 1,80 m long, i.e. at this depth an anchor or peg 111 is put into the coal seam. Such fastening takes place about every meter, in the direction of the width as well as the direction of the length of the tunnel 101. The fastened beam pieces or plates 104 may have different sizes, e.g. 1,2 m square.

I claim:

1. A drilling tool suitable for producing a drill hole which at relatively great depth is provided with a conical enlargement, in a soft material, comprising an axially elongated tool shank having a first end and a second end with a first drill to produce a basic cylindrical drill hole at the first end thereof and a second drill for producing a conical enlargement, said second drill in the direction of feed is provided in an articulated manner behind the first drill, said tool shank comprises a flattened part, said second drill includes bit holders which are attached in an articulated manner to both sides of said flattened part, a connecting link guide positioned between said flattened part and bit holders so that said bit holders can be swung out sideways, said connecting link guide comprising a slide block, a stop part rigidly attached to said connecting link guide, said stop part arranged to determine the setting depth of the conical enlargement, and an elongated slideway which is provided on the bit holders of the second drill and extends generally in the elongated direction of said tool shank, a spring in engagement with said link guide and said tool shank so that said link guide is movable relative to said tool shank against said spring, said connecting link guide comprises an elongated tie rod assembly located within said tool shank and having a first end closer to the first end of said tool shank and a second end, said slide block (53) is connected to the first end of said tie rod (46), said tool shank is hollow and cylindrically shaped and said tie rod assembly is guided essentially over its entire length concentrically inside said hollow cylindrical tool shank (12) in an axially movable manner relative to said tool shank, and the second end of said tie rod assembly is attached rigidly to said stop part (41, 41'), said flattened part (24) is located adjacent said first drill on said tool shank, and said slideway on said bit holders (26) of said second drill (17) comprises grooves (31) formed into the inside surfaces of said bit holders which face one another.

2. A drilling tool according to claim 1, characterized in that the flattened part (24) of the tool shank (12) includes a slot (52) extending in the axial direction of said tool shank, and said slot is covered substantially by said bit holders (26) of the second drill (17), said tie rod assembly comprises an axially elongated tie rod, and an at least partially flat tension piston (48), rigidly connected to said tie rod, and said slide block comprises a cross-pin (53) carried by and projecting on both sides from said flat tension piston.

3. A drilling tool according to claim 1 or claim 2, characterized in that the first drill is a core drill (16) which is attached to the flattened part (24) of the tool shank (12) in a detachable manner.

4. A drilling tool according to claim 1, characterized in that the tool shank (12) is provided, commencing from the first end thereof over a substantial part of its length with external spirals (36, 37) for removing drilled-out material, said flattened part (24) provided along the edges of the flattened surface thereof with spiral parts (36) forming interrupted parts of said spirals.

5. A drilling tool according to claim 2, characterized in that said tool shank (12) comprises a drill shank (19) and a drill holder (18) disposed in axial alignment, and a quick-change union (22) connecting said drill shank and drill holder together, drill shank (19) is exchangeable and includes said flattened part (24) with the first and the second drill (16, 17).

6. A drilling tool according to claim 5, characterized in that for removing said drill shank (19) from said drill holder (18) for exchanging purposes, the tension piston (48) provided with the sliding block (53) is attached to the tie rod (46) in such a manner that it can be rotated within said tool shank so that the slideways (31) are open at the end of the turned-out position of the second drill (17).

7. A drilling tool according to claim 5, characterized in that a coupling sleeve (21) is screwed into the drill holder (18) at the end thereof engageable with said drill shank, and said quick-change union is engageable with said drill shank and said coupling sleeve.

8. A drilling tool according to claim 7, characterized in that the tie rod (46) is surrounded by said spring (54), and at the one end said spring rests on the coupling sleeve (21) and at the other end on the tension bolt (48).

9. A drilling tool according to claim 1, characterized in that said stop part (41, 41') is provided on said tool shank (12) and is adjustable in the axial direction of said tool shank.

10. A drilling tool according to claim 9, characterized in that a cam (62) is fixed to said stop part (41, 41') said tool shank (12) has a longitudinal slot extending in the axial direction thereof and into which the end of the tie-rod (46) shaped as a threaded rod, can be screwed and attached axially by means of a clamping scres (66), and said cam penetrated into said longitudinal slot.

11. A drilling tool according to claim 10, characterized in that a guide flange is provided between the cam (62) and the stop part (41, 41'), said guide flange has rollers (59) therein for axially guiding on the outer periphery of the tool shank (12).

12. A drilling tool to claim 11, characterized in that a limiting part (42) is adjustably positioned on said tool shank (12) between the end (13) and the stop part (41,41') for determining the depth of the conical enlargement (106).

13. A drilling tool according to claim 12, characterized in that transverse grooves are provided in the outer surface of said tool shank and said limiting part (42) is movable in one of said transverse slots (67) provided on an outer peripheral zone of the tool shank (12).

14. A drilling tool according to claim 5, characterized in that an extension piece can be inserted between the drill holder (18) and the drill shank (19) and said tie rod (46) is exchangeable or extendable.

15. A drilling tool according to claim 1, characterized in that said stop part is a large-surface disc-shaped cutter head (41).

16. A drilling tool according to claim 15, characterized in that the cutter head (41) is provided with an axially extending central opening (83), a plurality of axial second openings (81) spaced outwardly from said central opening, and grooves (82) in said cutter head extending transversely of the axial direction to connect the central opening (83) to said second openings (81).

17. A drilling tool according to claim 16, characterized in that the edges of the second openings (81) of the cutter head (41) are shaped as cutting edges.

18. A drilling tool according to claim 15, characterized in that the cutter head (41) is provided with a plurality of cutting edges (86) arranged in a number of radially extending rows.

19. A drilling tool according to claim 1, wherein said stop part is shaped like a basket with the bottom thereof attached in a non-rotating manner to said tool shank, a stop ring ball bearing connecting said basket-like stop part to said stop ring, springs biasing said stop part in the axial direction and the bottom (87) of said stop part can be moved axially in relation to the stop ring (93) against the action of said springs (94).

* * * * *